US010544709B2

(12) United States Patent
Nitz et al.

(10) Patent No.: US 10,544,709 B2
(45) Date of Patent: Jan. 28, 2020

(54) SLIDING CAM MODULE WITH A BEARING ELEMENT AND A CAMSHAFT WITH A SLIDING CAM MODULE, AS WELL AS A COVER MODULE

(71) Applicants: thyssenkrupp AG, Essen (DE); ThyssenKrupp Presta TecCenter AG, Eschen (LI); Dr. Ing. h.c. F. Porsche AG, Stuttgart (DE)

(72) Inventors: Norbert Nitz, Chemnitz (DE); Jens Schirmer, Chemnitz (DE); Tobias Mehlhorn, Altenburg (DE); Dietmar Schwarzenthal, Ditzingen (DE)

(73) Assignees: Thyssenkrupp AG, Essen (DE); ThyssenKrupp Presta TecCenter AG, Eschen (LI); Dr. Ing. h.c. F. Porsche AG, Stuttgart (DE)

( * ) Notice: Subject to any disclaimer, the term of this patent is extended or adjusted under 35 U.S.C. 154(b) by 0 days.

(21) Appl. No.: 16/158,598

(22) Filed: Oct. 12, 2018

(65) Prior Publication Data

US 2019/0112950 A1 Apr. 18, 2019

(30) Foreign Application Priority Data

Oct. 13, 2017 (DE) ..... 10 2017 123 929

(51) Int. Cl.
*F01L 13/00* (2006.01)
*F01L 1/08* (2006.01)
(Continued)

(52) U.S. Cl.
CPC ..... *F01L 1/08* (2013.01); *F01L 1/044* (2013.01); *F01L 1/047* (2013.01);
(Continued)

(58) Field of Classification Search
CPC ..... F01L 2001/0473; F01L 2001/0476; F01L 1/267; F01L 1/46; F01L 2013/0052; F01L 2810/02; F01M 9/102
(Continued)

(56) References Cited

U.S. PATENT DOCUMENTS

2010/0175652 A1* 7/2010 Schoeneberg ..... F01L 1/047 123/90.21
2014/0137826 A1* 5/2014 Binder ..... B21D 53/845 123/90.18
2017/0284241 A1* 10/2017 Kataoka ..... F01L 1/022

FOREIGN PATENT DOCUMENTS

DE 102007027979 A1 * 1/2009 ..... F01L 1/053
DE 102007027979 A1 1/2009
(Continued)

*Primary Examiner* — Jorge L Leon, Jr.
(74) *Attorney, Agent, or Firm* — Hamre, Schumann, Mueller & Larson, P.C.

(57) ABSTRACT

The present invention relates to a sliding cam module for a camshaft, which comprises at least one sliding cam with at least one cam segment, comprising at least two cams with cam tracks that are different to one another as well as a closed bearing element, which is arranged on the sliding cam in a rotatable and axially non-displaceable manner for mounting the sliding cam, wherein the bearing element comprises a recipient area to hold at least one section of a locking device to lock the sliding cam in an axial position. Furthermore, the invention relates to a camshaft with at least one corresponding sliding cam module as well as a shaft, on which the sliding cam module is arranged in a rotationally fixed manner and can be moved in an axial direction along a longitudinal axis of the shaft and a cover module, which comprises a cylinder-head cover as well as a closed bearing element, which comprises a recipient area to hold at least one section of a locking device to lock the sliding cam in an axial position.

12 Claims, 4 Drawing Sheets

Figure 1:
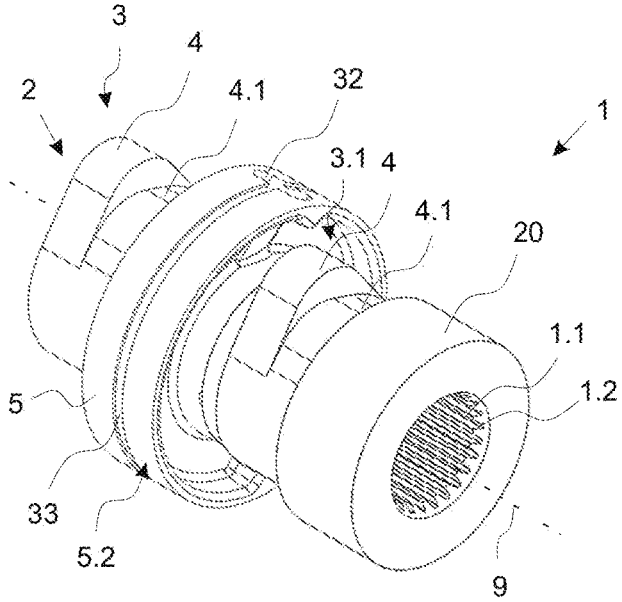

(51) Int. Cl.
*F01L 1/04* (2006.01)
*F01L 1/047* (2006.01)

(52) U.S. Cl.
CPC ..... *F01L 2001/0471* (2013.01); *F01L 2001/0476* (2013.01); *F01L 2013/0052* (2013.01)

(58) Field of Classification Search
USPC ..... 123/90.18, 90.34
See application file for complete search history.

(56) References Cited

FOREIGN PATENT DOCUMENTS

| | | | | |
|---|---|---|---|---|
| DE | 102009049464 | A1 | 4/2011 | |
| DE | 102011001625 | A1 | 10/2012 | |
| DE | 102011050484 | A1 | 11/2012 | |
| DE | 102011052912 | A1 | 2/2013 | |
| DE | 102012103751 | A1 | 10/2013 | |
| DE | 102012109202 | A1 | 6/2014 | |
| DE | 102012111856 | A1 | 6/2014 | |
| DE | 102013113349 | A1 | 6/2015 | |
| DE | 102014116480 | A1 * | 5/2016 | ..... F01L 13/0036 |

* cited by examiner

SLIDING CAM MODULE WITH A BEARING ELEMENT AND A CAMSHAFT WITH A SLIDING CAM MODULE, AS WELL AS A COVER MODULE

The present invention relates to a sliding cam module for a camshaft, wherein the sliding cam module comprises a bearing element to mount a sliding cam of the sliding cam module. Furthermore, the present invention relates to a camshaft with a corresponding sliding cam module, as well as a cover module with a cylinder-head cover and a bearing element arranged in the cylinder-head cover.

MOST RECENT PRIOR ART

It is regarded as fundamentally known that, for mounting sliding cams, in particular, for the radial mounting of sliding cams, the slide cams themselves are either mounted directly by arranged the corresponding bearing on the sliding cam, or indirectly, by mounting the sliding cams via a driving shaft of a camshaft. It is also regarded as fundamentally known that a locking of the sliding cam in its corresponding position can be ensured by means of a ball-and-spring mechanism, which fixes the sliding cam in the correspondingly switch axial position on the basis of a thrust bearing of the shaft. As an alternative to this, it is regarded as fundamentally known that the latch system pulls the sliding cam in the axial direction applying force against a contact surface in order to reduce the tolerance chain. However, this creates additional friction throughout the whole system.

Latching of a sliding cam is, for example, shown in DE10 2011 050 484 A1, DE10 2012 103 751 A1 and DE10 2012 111 856 A1. In these publications, an internal combustion engine is respectively described, comprising a cylinder head and a cylinder-head cover designed to be opposite to the cylinder head as a separate element or designed a single piece together with the cylinder head. A rotatably mounted camshaft, which comprises at least one sliding cam that is axial displaceable on the camshaft, is used to actuate the gas exchange valves. Thereby, the sliding cam comprises a gate section with a groove formed on an outer shell surface of the gate section to cause an axial displacement of the respective sliding cam. Here, an actuated pin engages into the groove of the sliding cam. In order to lock the sliding cam along the axial direction, in particular, along the longitudinal direction of the shaft, a means is used, which is formed or arranged in the area of the gate section. It is also possible that the pin used to actuate the sliding cam is used to latch the sliding cam itself. However, the embodiments disclosed in the mentioned publications to make the latching of the sliding cam possible require a plurality of means and elements that can be operationally connected to one another, whereby strong levels of stress on the pin of the actuator for making the axial displacement of the sliding cam possible also result.

The use of radial bearings, in particular, radial bearings arranged in a cylinder-head cover, can be found in DE10 2009 049 464 A1 In this publication, a cylinder-head cover of an internal combustion engine is shown, on which arranged radial bearing devices for a camshaft are made available. The camshaft is rotatably mounted to a cylinder-head cover. The radial bearing devices are designed as bearing blocks and each comprise a bearing ring body.

DISCLOSURE OF THE INVENTION

Therefore, it is the object of the present invention to at least partially eliminate the previously described disadvantages. In particular, it is the object of the present invention to create a sliding cam module for a camshaft was well as a corresponding camshaft for arrangement in a cylinder-head cover and a corresponding cover module, having at least one cylinder-head cover, which makes a reduction of the tolerance chain between the actuator pin and the shifting gate possible in an easy and inexpensive manner. Furthermore, it is the task of the present invention to avoid locking holes within the shaft of a camshaft to make the arrangement or the engagement of a locking device possible in order to reduce notch effects of the shaft and to minimize the processing costs of the shaft.

The preceding task is achieved by means of a sliding cam module for a camshaft described herein, as well as by means of a camshaft with at least one sliding cam module as described herein. Furthermore, the preceding task is achieved by means of a cover module for arrangement on a cylinder head of an internal combustion engine as described herein. Other features and details of the invention result from the subclaims, the description and the drawings. Thereby, the features and details, which are described in conjunction with the sliding cam module according to the invention and the camshaft according to the invention and the cover module according to the invention, also naturally apply in conjunction with the cover module according to the invention or the camshaft according to the invention or the sliding cam module according to the invention in such a way that, as regards the disclosure, reference can always be reciprocally made to individual inventive aspects.

The sliding cam module according to the invention for a camshaft comprises at least one sliding cam with at least one cam segment, comprising at least two cams with cam tracks that are different to one another as well as a closed bearing element, which is arranged on the sliding cam in a rotatable and axially non-displaceable manner for mounting the sliding cam. The bearing element comprises a recipient area to hold at least one section of a locking device to lock the sliding cam in an axial position. It is possible that the cam segment is designed as a single piece with the sliding cam, in particular, being made from the sliding cam's material. It is also possible that the cam segment is connected to the sliding cam or joined to the sliding cam, in particular, being arranged on it or pressed onto it. It is also conceivable that the sliding cam comprises two or a plurality of cam segments. Thereby, it is possible that one of the cam segments is designed as a single piece with the sliding cam while another one of the cam segments, in particular, the second cam segment, is connected to the sliding cam or joined to the sliding cam, in particular, being arranged on it or pressed onto it. Being favourable, the sliding cam is designed as a single piece along with the cam segment. It is particularly advantageous if the sliding cam is an integrated sliding cam. Consequently, it is particularly favourable if the sliding cam module is an integrated sliding cam module. Under the term "integrated elements and modules", in terms of the invention, element or modules are understood that consist of at least two or a plurality of parts or components. The at least two cams of the cam segment are favourably designed as full-stroke cams or zero-stroke cams. It is also conceivable that the cam segment comprises more than two, in particular, three or a plurality of cams which are arranged next to each other viewed in the axial direction. The bearing element arranged on the sliding cam in a rotationally and axially non-displaceable manner (not displaceable, but axially fixed) is designed as a closed bearing element according to the invention. Within the scope of the invention, a bearing element is understood as a closed bearing element so that this does not have to be assembled from a plurality of bearing element parts to form a closed bearing element. Favourable, the bearing element is designed as a radial bearing, being particularly favourable, designed as a sliding bearing. Within the scope of the invention, as a bearing element, a bearing element arranged in a non-displaceable manner is understood, which is arranged on the sliding cam in an immoveable manner in such a way that a displacement of the bearing element in the axial direction together solely with the sliding cam can be caused. The locking of the bearing element itself in an axial position consequently prevents an undesired movement of the sliding cam and thus, of the entire sliding cam module in an axial direction, in particular, along a shaft of a camshaft. Thereby, as an axial position, favourably, a first and a second axial position are understood, which are formed at a distance to one another viewed in the axial direction along the longitudinal axis of the sliding cam module. In particular, in the case of the embodiment of a cam segment with two cams, the sliding cam module has the possibility of being locked in two axial positions and being moved between these two axial positions. Thereby, it is conceivable that, in the case of an embodiment of a cam segment with three cams, a movement of the sliding cam module is possible between three axial positions in an axial direction, wherein the sliding cam module can be locked into these three axial positions. Favourably, the number of axial positions that are formed and can be possibly assumed corresponds to the number of cams of the cam segment of the sliding cam.

By means of the sliding cam module according to the invention, favourably, the required tolerance chain of the components is reduced. Furthermore, the sliding cam module according to the invention makes a reduction of the processing effort on a shaft of a camshaft possible, which interacts with the sliding cam module. In addition, favourably, a direct mounting of the sliding cam is made possible, wherein, at the same time, a reduced valve distance around the displacement path can be implemented within the valve train of the internal combustion engine since the cams, which are not engaged with the tapping elements of the valve train can favourably submerge under the bearing guide, in particular the bearing guide elements of the cylinder-head cover (as will still be described in detail in the following). A reduction of the shaft diameter of the camshaft is deemed another advantage without this leading to an impairment in functionality.

It is furthermore conceivable that the locking device comprises a spring element as well as an engagement element interacting with the spring element. Thereby, the spring element is favourably designed as a pressure-spring element. The engagement element is favourably pressed by the spring element against and into the recipient area of the bearing element and pressed out of this. Favourably, the engagement element is spherical. By means of this a simpler and more inexpensive construction of a locking device is made possible.

In addition, it is possible that recipient area is a blind hole extending inwardly in the radial direction to receive at least the spring element of the locking device. This means that this bore hole, in particular, a blind hole extends from the outer surface of the bearing toward the inside, in particular, inwardly in a radial direction. In the case of the arrangement of the spring element, the blind hole is used to generate a retaining force, in particular an opposing force so that this can create a defined pressure force on the engagement element. It is also possible that the recipient area also at least partially accommodates the engagement element. Thereby, the engagement element is at least partly arranged within the blind hole. Thereby, it is conceivable that the blind hole, for example, has a chamfer in the area of the outer surface of the bearing.

As an alternative, it is possible that the recipient area is a latching element to hold the engagement means of the locking device. Advantageously, the latching element consists of a plurality of recesses or depressions, which extend from an outer surface of the bearing toward the inside. Favourably, the latching element is designed to be geometrically adapted to the shape of the engagement element. That means that, provided the engagement element is spherical, for example, the depressions of the latching element have a ball-socket shape. The number of depressions and recesses of the latching element favourably corresponds to the number of cams per cam segment. The depression and recesses of the latching elements are adjacent to one another in the axial direct and favourably adjoin each other. Being particularly favourable, the recesses and depressions of the latching element form a wave shape extending into the axial direction.

Furthermore, it is conceivable that the sliding cam module comprises a shifting gate with a guide path to hold a pin element to displace the sliding cam module in the axial direction along a shaft of a camshaft. It is furthermore conceivable that the shifting gate is designed as a single part or a single piece with the sliding cam. It is also possible that the shifting gate is made of the material used to make the sliding cam or that it is attached to the sliding cam or joined to the sliding cam.

Within the scope of the invention, it is furthermore possible that the bearing element comprise a lubricant channel extending into the radial direction at least in sections, which flows into a lubricant outlet opening on an inner surface of the bearing element. Favourably, the lubricant channel is designed to be a bore hole. A flowable medium is favourably used as a lubricant, such as oil for example. It is furthermore possible that the lubricant channel runs transversely through the material of the bearing element from its outer surface to its inner surface, thereby taking the rotational direction of the sliding cam operationally connected to the bearing element.

It is furthermore conceivable that a lubricant intake is designed on the outer surface of the bearing element and is connected to the lubricant channel in a fluid-conveying manner. The lubricant intake, which is designed at or on the outer surface of the bearing element, is favourable shaped as a depression with a geometry that is different from the lubricant channel. Favourably, the lubricant intake is geometrically broader or wider than the lubricant channel viewed in the tangential direction and/or in the axial direction.

It is also possible that the lubricant intake extends in the geometric shape of an elongated hole in the axial direction along an outer surface of the bearing element. In accordance with this, the lubricant intake extends in the width direction on the outer surface of the bearing element. By means of this, favourably, when displacing the sliding cam or the sliding cam module from an axial position into another axial position, entry of the lubricant into the lubricant intake is made possible.

It is furthermore conceivable that the bearing element comprise a lubricant groove to distribute the lubricant, which extends on an outer surface of the bearing element in the circumferential direction at least in sections. The lubricant groove is favourably designed as a depression consisting of one or a plurality of grooves. Being particularly favourable, the lubricant groove fully extends into the circumferential direction. The lubricant groove is favourably used to distribute the lubricant, in particular, also to collect temporarily excessive lubricant in the area of the bearing element, in particular, in the area of the outer surface of the bearing element. Favourably, it is furthermore conceivable that lubricant is also applied to locking device of the sliding cam module in order to minimize frictional forces when displacing the sliding cam, whereby, as a result, wear of the locking device is reduce, being favourably avoided.

Within the scope of the invention, furthermore, a camshaft with at least one sliding cam module is claimed in accordance with the aforementioned type. Additionally, the camshaft comprises a shaft, on which the sliding cam module is arranged in a rotationally fixed manner and in the axial direction along a longitudinal axis of the shaft. The shaft of the camshaft is designed either as solid shaft or hollow shaft. In the case of the rotationally fixed arrangement of the sliding cam module on the shaft, favourably, a torque transmission is made possible between the shaft and the sliding cam module. The sliding cam module is arranged on the shaft in such a way that the sliding shaft module itself is arranged between the specified axial position on the shaft in the axial direction in a moveable manner.

It is furthermore conceivable that the shaft comprises a toothing, in particular, a longitudinal toothing on its outer surface at least in sections. It is furthermore conceivable that the sliding cam module comprises a through bore extending in the axial direction, through which the shaft extends, wherein the surface of the through bore comprises a toothing, in particular, a longitudinal toothing. In the case of forming the toothing or the longitudinal toothing in the area of the outer surface of the shaft as well as of the surface of the through bore of the sliding cam module, an engagement of the toothings of both elements is possible if the shaft is pushed through the through bore of the sliding cam module and, consequently, the sliding cam module is arranged on the shaft. Due to the formation of the toothing or the longitudinal toothing, an arrangement, which is rotationally fixed and that can be displaced in the axial direction, of the sliding cam module on the shaft of the camshaft is made possible. However, it would also be conceivable that, instead of the mentioned toothings or longitudinal toothings, other engagement elements are formed on the outer surface of the shaft or on the surface of the through bore of the sliding cam module, which ensure a corresponding arrangement.

In the case of the described camshaft according to the invention, all the advantages result, which have already been described concerning the sliding cam module according to the invention in accordance with the first aspect of the invention.

Furthermore, a cover module for arrangement on a cylinder head of an internal combustion engine is claimed, which comprises a cylinder-head cover to hold at least one camshaft in accordance with the aforementioned type as well as a closed bearing element, which comprises a recipient area to hold at least one section of a locking device to lock the sliding cam in an axial position. In accordance with this, it is conceivable that the cover module consists of at least the cylinder-head cover and the bearing element, which is connected to the cylinder-head cover before arrangement, for example, of a sliding cam or a shaft of a camshaft, having a sliding cam in order, for example, to be used as a module, in particular as a supply module for further processing or for further transport (e.g. on another assembly line etc.). Thereby, it is possible that the bearing element is arranged on a correspondingly predefined point in the cylinder-head cover, in particular in the area of the bearing bridges, which can be designed as open or closed bearing bridges, in a rotationally fixed manner, however in the axial direction in a shifting manner (along the longitudinal axis of the bearing path).

Furthermore, it is possible that the cover module comprises at least a camshaft arranged being supported in the cylinder-head cover in accordance with the aforementioned type. It is also conceivable that the cover module comprises at least one sliding cam arranged being supported in the cylinder-head cover, which is arranged, in particular, in the cylinder-head cover, in particular in the bearing element in a rotatable manner, thereby being non-displaceable in the axial direction (displacement-proof), before inserting a shaft to form a camshaft.

Furthermore, it is possible that the cylinder-head cover comprises at least one bearing path for mounting a camshaft, in particular, a camshaft of the aforementioned type, as well as at least two bearing guide elements, which are spaced away from each other in the axial direction, wherein the bearing element is arranged in a rotationally fixed manner, thereby being displaceable in the axial direction on at least one of the bearing guide elements. It is also conceivable that a bearing element is arranged on both bearing guide elements, as has been previously described. It would also be conceivable that, in addition to the closed bearing element, as previously described, another bearing element, which has a different construction, is arranged on one of the bearing guide elements. For example, a split bearing.

Furthermore, it is possible that at least one of the bearing guide elements, on which the closed bearing element is arranged, comprises a lubricant supply line, which leads along a contact surface of the bearing guide element for contacting the bearing element. Favourably, the lubricant supply line flows in the area of the lubricant intake of the arranged bearing element so that, regardless of the axial position assumed by the sliding cam module, a lubricant, such as oil for example, can be transferred from the cylinder-head cover to the bearing element.

In the case of the described cover module according to the invention, all the advantages result, which have already been described concerning the sliding cam module according to the first aspect of the invention as well as concerning a camshaft in accordance with the second aspect of the invention.

It is to be understood that the features explained in the aforementioned and following cannot only be used in the respectively indicated combination, but also in other combinations or alone, without departing from the scope of the present invention.

Embodiments of the sliding cam module according to the invention, the camshaft according to the invention or of the cover module according to the invention will be explained in the following based on the drawings. On a schematic level respectively, the figures show FIG. 1 a perspective view of an embodiment of a sliding cam module according to the invention, FIG. 2 the embodiment of a sliding cam module according to the invention shown in FIG. 1 in a lateral cross-sectional view arranged in a cylinder-head cover to form an embodiment of a cover module according to the invention.

Figure 2:
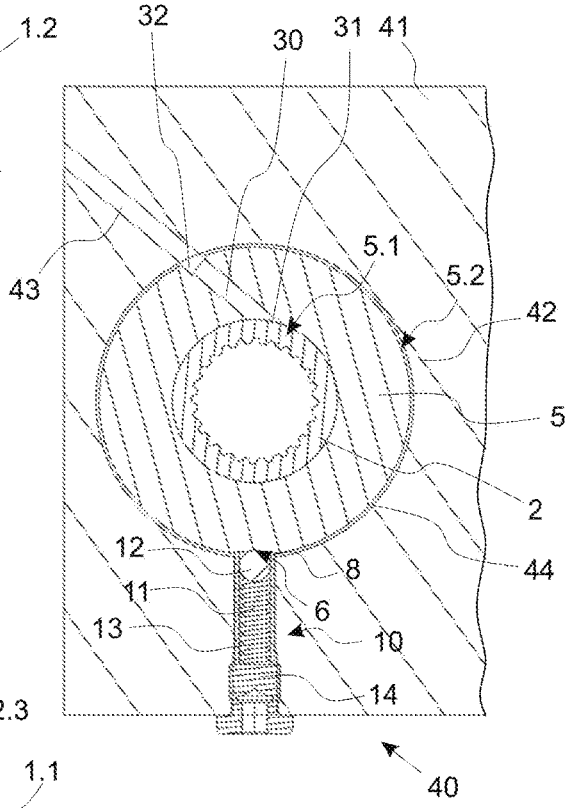
Figure 3:
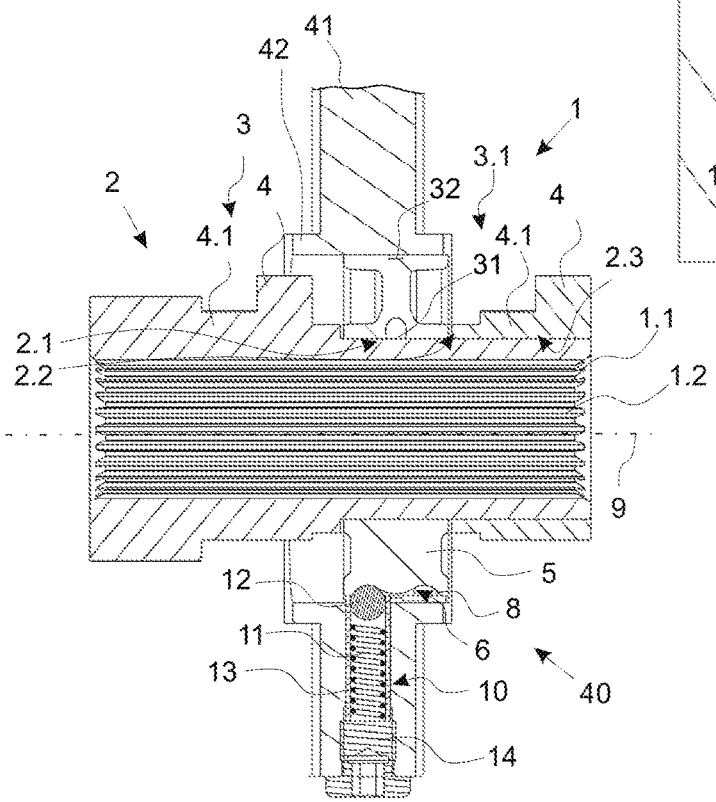
Figure 4:
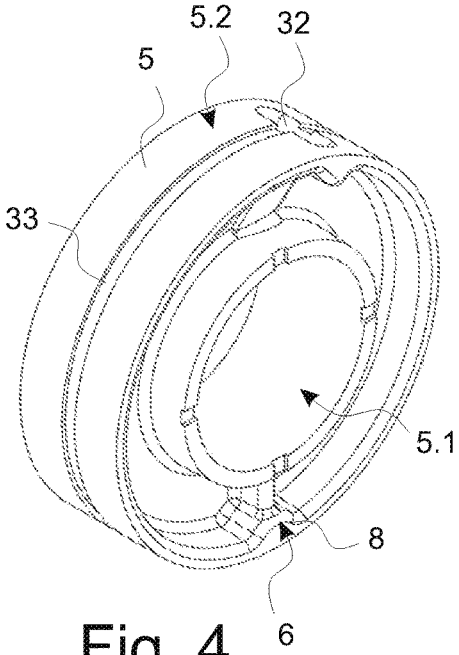
Figure 5:
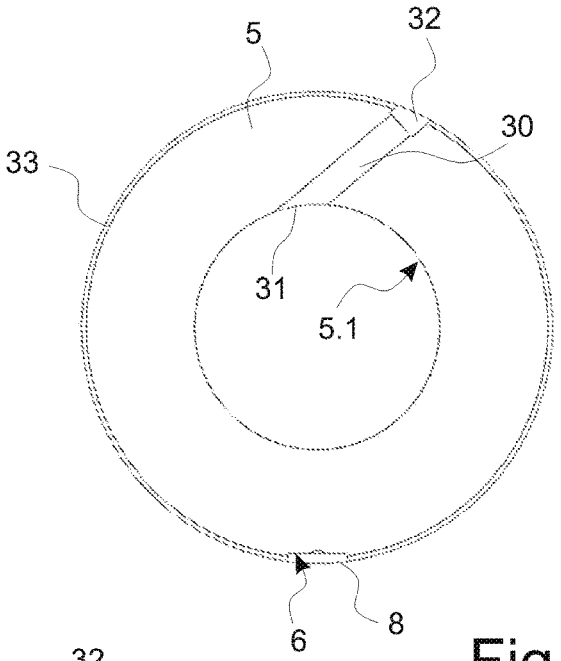
Figure 6:
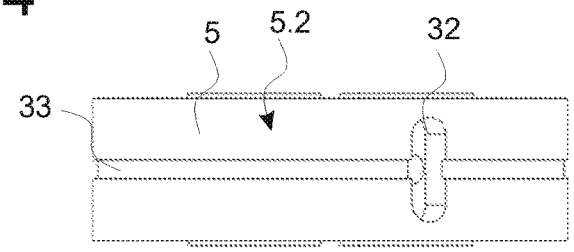
Figure 7:
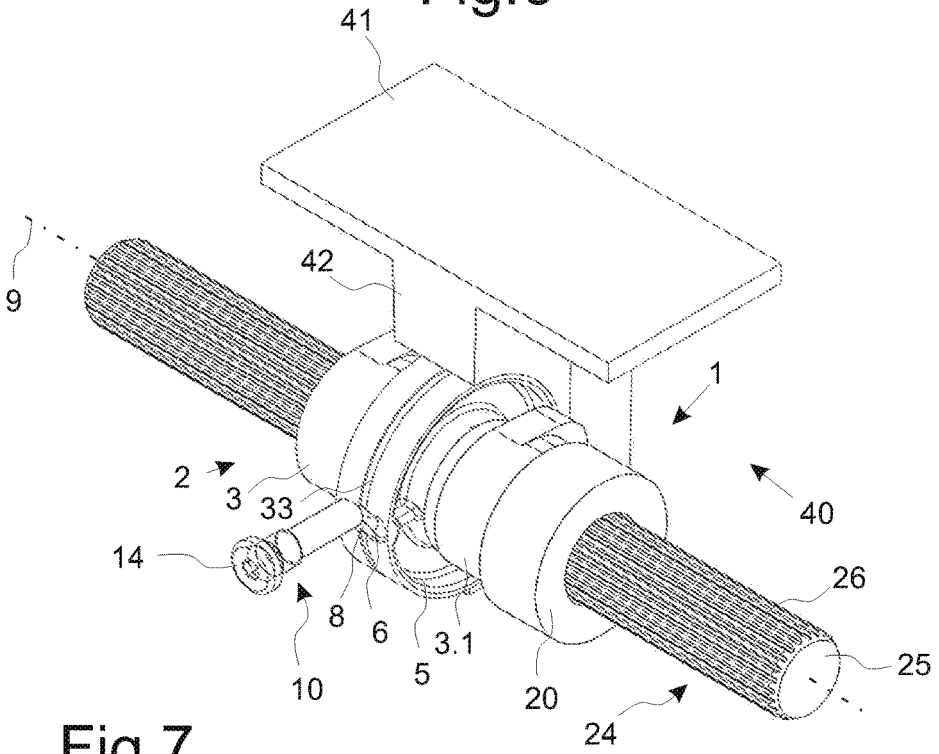
Figure 8:
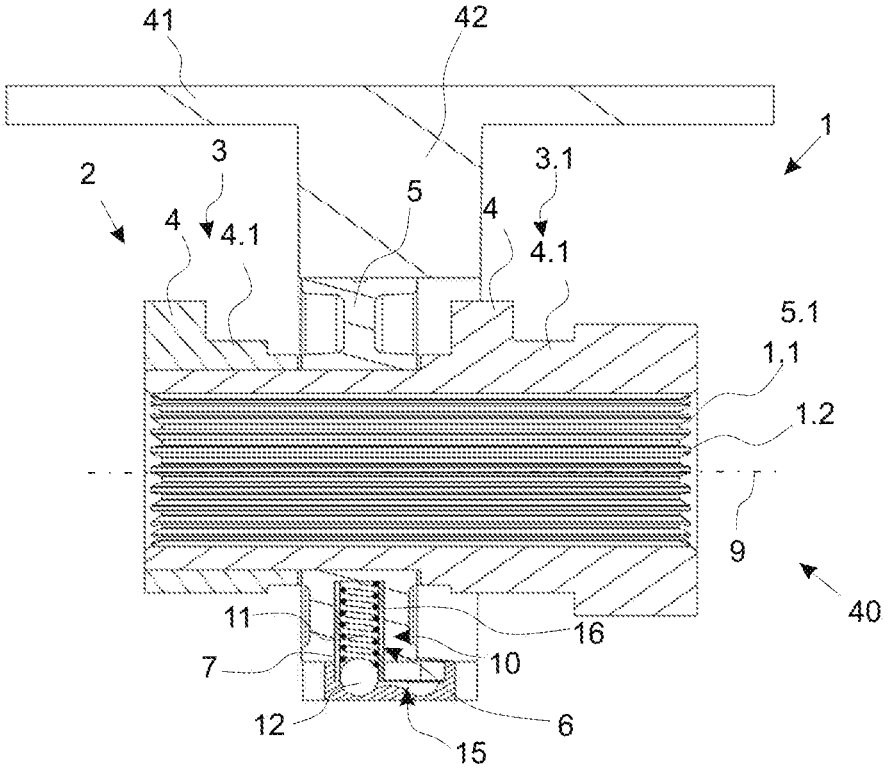
Figure 9:
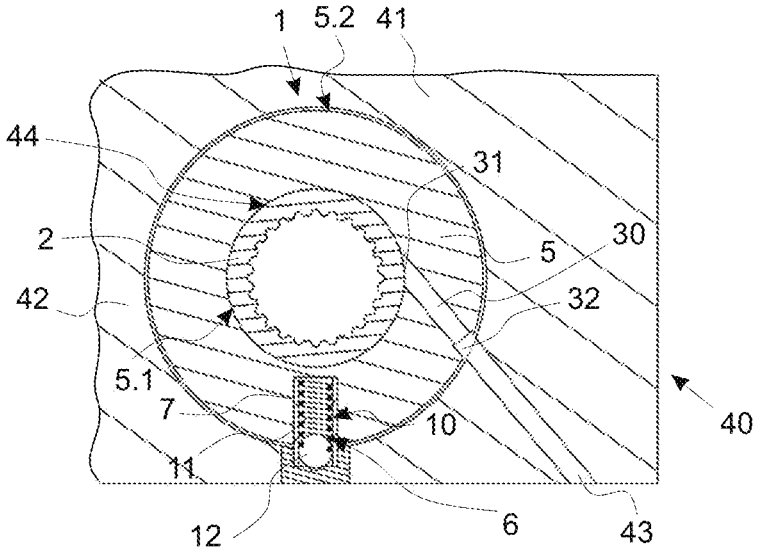
Figure 11:
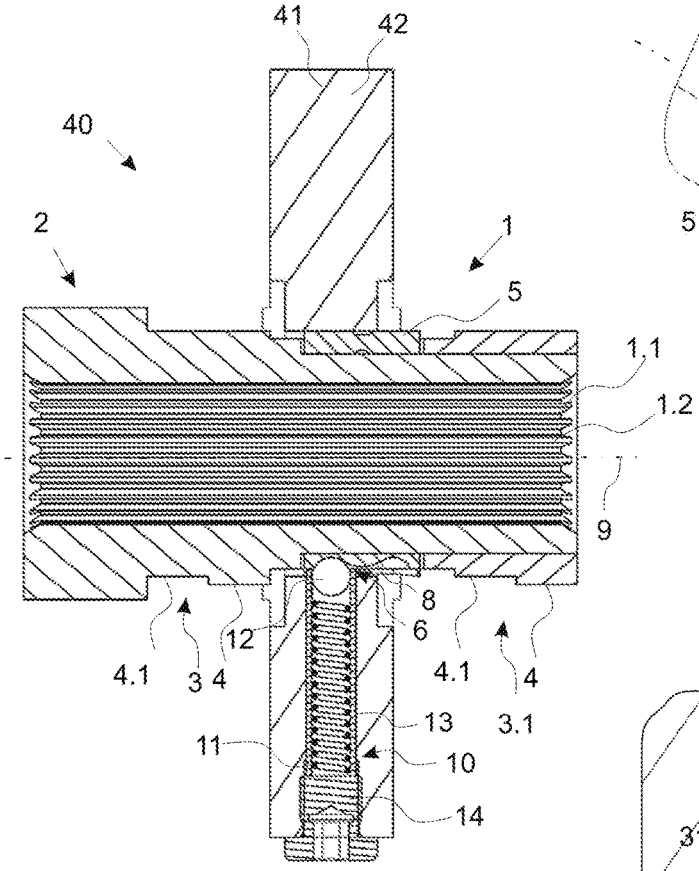
Figure 10:
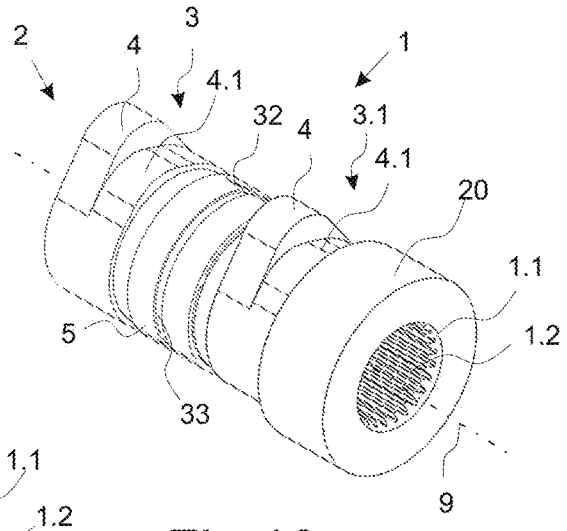
Figure 12:
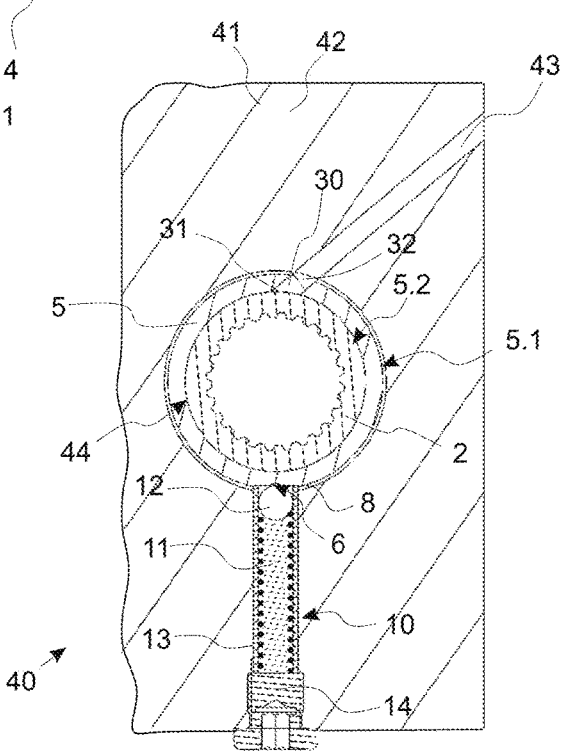

FIG. 3 the embodiment shown in FIG. 2 in a cross-sectional view,

FIG. 4 a perspective view of an embodiment of a bearing element,

FIG. 5 The embodiment of a bearing element shown in FIG. 4 in a cross-sectional view, FIG. 6 the embodiment of a bearing element shown in FIGS. 4 and 5 in top view, FIG. 7 a perspective view of a section of an embodiment of a cover module according to the invention, which comprises an embodiment of a camshaft according to the invention, FIG. 8 another embodiment of a sliding cam module according to the invention in a lateral cross-sectional view arranged in a cylinder-head cover to form an embodiment of a cover module according to the invention, FIG. 9 the embodiment shown in FIG. 8 in a cross-sectional view, FIG. 10 a perspective view of another embodiment of a sliding cam module according to the invention, FIG. 11 the embodiment of a sliding cam module according to the invention shown in FIG. 10 in a cross-sectional view arranged in a cylinder-head cover to form another embodiment of a cover module according to the invention, and FIG. 12 the embodiment shown in FIG. 11 in a cross-sectional view.

Elements with the same function and mode of action are provided in FIGS. 1 to 12 with the same reference numbers respectively.

In FIG. 1, a perspective view of an embodiment of a sliding cam module 1 according to the invention. The sliding cam module 1 has a sliding cam 2, which comprises a cam segment 3 and another cam segment 3.1. Each of the cam segments 3 and 3.1 each have two cams, 4 and 4.1, to form a full-stroke cam and a zero-stroke cam. As is shown in FIG. 1, consequently, cams 4 and 4.1 of the respective cam segments 3 and 3.1 comprise cam tracks that are different from one another. Furthermore, the sliding cam module 1 comprises a bearing element 5, which is arranged between cam segments 3 and 3.1. The bearing element 5 comprises a lubricant groove 33 having a depression, which fully extends in the circumferential direction on the outer surface 5.2 of the bearing element 5. Furthermore, on the outer surface 5.2 of the bearing element 5, a lubricant intake 32 is formed, which particularly extends in the axial direction, meaning in the width direction of the bearing element 5. The lubricant intake 32 is connected to the lubricant groove 33 in a fluid-conveying manner. When a defined amount of flowable lubricant accrues, this is transported from the lubricant intake 32 into the lubricant groove 33 in order to favourably ensure a sufficient lubricant supply to the circumferential surface, in particular for the outer surface 5.2, whereby, favourably, a low-friction displacement in the axial direction can be ensured. Provided more lubricant is introduced in to the lubricant intake 32 and, consequently, into the lubricant groove 33 than can be accommodated from this, the lubricant escapes into the gap between the bearing element 5 and the cylinder-head cover 41. Furthermore, a shifting gate 20 is shown in FIG. 1 which is used, in interaction with an actuator (not shown here), to make the displacement of the sliding cam module 1 along a longitudinal axis 9, provided that the sliding cam module 1 is arranged on a shaft (not shown here). In respect thereof, the shifting gate 20 favourably comprise a guide groove (not shown here), which is designed, for example as a Y-groove or a double-S-curve groove. The shifting gate 20 is favourably designed as a single piece with the sliding cam 2 to form a sliding cam module 1. It is also conceivable that the sliding cam 2 as well as the shifting gate 20 are designed as a single piece. The sliding cam module 1 additionally comprises a through bore 1.1, which extends in the axial direction along the longitudinal axis 9. The through bore 1.1 is used to hold a shaft (not shown here) to form a camshaft. The through bore 1.1 additionally comprises a toothing, in particular, a longitudinal toothing 1.2, which extends in the direction of the longitudinal axis 9, meaning in the axial direction along the surface of the through bore 1.1. Thereby, the number of teeth of the toothing or longitudinal toothing 1.2 is not limited or restricted to a defined number or can be variably selected.

In FIGS. 2 and 3, the embodiment of the sliding cam module 1 shown in FIG. 1 accommodated in a cylinder-head cover 41 is shown in a different cross-sectional illustration. As is shown in FIGS. 2 and 3, the bearing element 5 comprises a lubricant intake 32, which is connected to a lubricant channel 30 in a fluid-conveying manner. The lubricant channel 30 leads from an outer surface 5.2 of the bearing element 5 through the material of the bearing element 5 primarily at a defined angle radially inwardly to the inner surface 5.1 of the bearing element 5, in particular, to a lubricant outlet opening 31, which is formed on the inner surface 5.1 of the bearing element 5. By means of this, it is possible to transport the lubricant supplied via a lubricant supply line 43 of the cylinder-head cover 41 to the inner surface 5.1 of the bearing element 5, in particular to the contact surface 44 of the cylinder-head cover 41, in particular to the bearing guide element 42 of the cylinder-head cover 41 in order to make a sliding bearing between the bearing element 5 and the sliding cam 2 possible. Furthermore, a locking device 10 is shown, which comprises a spring element 11 as well as an engagement element 12. The engagement element 12 is favourably designed in the shape of a sphere. The spring element 11 is arranged in a recess 13, which extends at least in sections through an area of the bearing guide element 42 of the cylinder-head cover 41. Thereby, the recess 13 is favourably designed as a through bore. A closure element 14 is used to hold and lock the spring element 11. This is arranged on the outer side of the bearing guide element 42 and outwardly seals the recess 13 in the axial direction. Consequently, the spring element 11 is positioned on the closure element 14 and the spring element 11 contacts the closure element 14 in such a way that, by means of the closure element 14, a counter force is applied to the spring element 11. This required so that the spring element 11 can cause a compressive force on the engagement element 12. The engagement element 12 is engaged with a recipient area 6 of the bearing element 5. The recipient area 6 is favourably designed as a latching element 8 in the embodiments in accordance with FIGS. 2 and 3. The latching element 8 comprises at least one depression formed in the axial direction along the longitudinal axis 9 with a wave shape or a W-shape, in particular two depressions arranged adjacent to one another. Favourably, the depression can also be designed in the form of two adjacent V-grooves with variable angles. The depressions and recesses, which primarily form a wave shape, are favourably geometrically comparable to the embodiment of the engagement element 12. According to this, the depressions favourably also comprise a spheroidal shape respectively, in particular being spherical. The latching element 8, in particular, the embodiment of depression using at least two adjacent depressions viewed in the axial direction make the arrangement of the engagement element possible, in particular in a first or a second or, favourably, also another axial position. Thereby, favourably, a first one of depression is the first axial position while the other (second one) of the depressions represents the second axial position etc.

According to the invention, the sliding cam 2 is favourably mounted or pre-mounted to the single-piece (closed)

bearing element 5. Thereby, the bearing element 5 is favourably positioned and arranged on a mounting section 2.1 of the sliding cam 2. Thereby, favourably, the bearing element is inserted onto the sliding cam 2 far enough until this contacts a cam segment 3 or 3.1, which already formed and arranged on the sliding cam 2. In order to prevent an undesired displacement of the bearing element 5 in the axial direction, in the following, another cam segment 3.1, which can be referred to as a joined cam segment, is pushed onto the sliding cam 2, in particular, onto a positioning section 2.3 of the sliding cam 2, and that being favourably far enough into the axial direction until the other cam segment 3.1 also contacts or almost contacts the bearing element 5 in order to ensure a rotational movement of the sliding cam 2. The bearing element 5 is consequently arranged between the (first) cam segment 3 and the other (joined) cam segment 3.1. Favourably, a material elevation, for example, in the form of a toothing or aggregate layer (not shown here) is applied to the outer surface 2.2 in the area of the positioning segment, by means of which a material displacement is generated when applying the other cam segment 3.1 and consequently, a press fit is implemented. By means of this, manufacturing an embodiment of a sliding cam module 1 according to the invention is made possible.

It is conceivable that the bearing element 5 is manufactured (mounted) together with the sliding cam 2 as a sliding cam module 1 and is built into and arranged in the cylinder-head cover 41 as a unit during a later (subsequent) process step. Since the locking of the sliding cam 2, in particular, of the sliding cam module 1 is made possible by means of the locking device 10, which is arranged between the bearing element 5 and the cylinder-head cover 41, favourably, processing effort can be reduced for the inner diameter of the sliding cam 2, in particular for the inner surface in the area of the through bore 1.1 of the sliding cam 2. Favourably, by means of this, it is possible to also manufacture the closed bearing element 5 in split cylinder-head cover mountings or in split bearing frames.

In FIGS. 4 to 6, a preferred embodiment of a bearing element 5 is shown in various views. Here, the bearing element 5 comprises an outer surface 5.2, on which a lubricant groove 33 fully extends in the circumferential direction, which is connected to a lubricant intake 32 in a fluid-conveying manner. The lubricant intake 32 primarily extends in the form of an elongated hole or an elongated hole depression or a depression, which ensures an overlapping with the lubricant supply line 43 in all assumable axial positions in order to ensure fluid conveyance in the axial direction, meaning in the width direction of the bearing element 5. Furthermore, the embodiment of a lubricant channel 30 is shown, which is connected to the lubricant intake 32 in a fluid-conveying manner and extends from an outer surface 5.2 of the bearing element 5 to an inner surface 5.1 of the bearing element 5 and favourably leads into a lubricant outlet opening 31. Furthermore, a recipient area 6 of the bearing element is shown, which is favourably designed as a latching element 8 to particularly hold an engagement element 12 of a locking device 10, as is shown in FIGS. 2 and 3. Favourably, the recipient area 6 is spaced away from the area of the lubricant channel 30 and consequently lines on the opposite side of the bearing element 5 in a favourable manner.

An embodiment of a sliding cam module 1 according to the invention arranged in a cylinder-head cover 41 to form an embodiment of a cover module 40 according to the invention shown in FIG. 7. Furthermore, FIG. 7 shows an embodiment of a camshaft 24 according to the invention, which comprises a shaft 25 as well as a sliding cam 2 or the sliding cam module 1. The embodiment shown of the sliding cam module 1 according to the invention shown in FIG. 7 essentially corresponds to the embodiment of a sliding cam module 1 according to the invention shown in FIG. 1 so that the features and advantages concerning this explained here can be accordingly taken into consideration. The sliding cam module 1 is arranged in a bearing guide element 42 of the cylinder-head cover 41. The bearing guide element 42 is, for example, is designed as a bearing bridge, such as a split bearing bridge or, favourably, also a closed bearing bridge. A lubricant supply line 43 to convey or supply a lubricating medium or lubricant to the bearing element 5 extends through the material of the bearing guide element 42 of the cylinder-head cover 41 as is particularly shown in FIG. 3. A shaft 25, which is designed as a solid shaft in accordance with FIG. 7, extends through the through bore 1.1 of the sliding cam module 1. The shaft 25 comprises a toothing/longitudinal toothing 26, which is engaged with a toothing/longitudinal toothing 1.2 (not shown, hidden) (in comparison to FIG. 2) of the sliding cam module 1 in order to make a displacement of the sliding cam module 1 in the axial direction along the longitudinal axis 9 possible, in the case of consistent torque transmission between the shaft 25 and the sliding cam module 1.

In FIGS. 8 and 9, another embodiment of the sliding cam module 1 according to the invention is shown as well as its arrangement in a cylinder-head cover 41 to form another embodiment of the cover module 40 according to the invention, shown in different cross-sectional views. Deviating from the embodiment of a sliding cam module 1 according to the invention shown in FIGS. 2 and 3, the embodiment of a sliding cam module 1 according to the invention shown in FIGS. 8 and 9 comprises a bearing element 5, the recipient area 6 of which is designed in the form of a blind hole 7. The blind hole 7 primarily extends from an outer surface 5.2 of the bearing element 5 inwardly in the radial direction. The blind hole 7 favourably is at least partially used or used in sections to hold the locking device 10, which comprises a spring element 11 as well as an engagement element 12. The spring element 11 is favourably fully accommodated within the blind hole 7 while the engagement elements 12 is engaged with the latching means 15, which is formed in the cylinder-head cover 41, in particular, in the bearing guide element 42 of the cylinder-head cover 41. It is furthermore conceivable that, in addition to the design of the blind hole 7, a sleeve 16 is arranged in the blind hole 7 in order to make a removal of the engagement elements 12 in the radial direction possible, in particular, in the direction of the latching means 15. Favourably, it is also conceivable that the sleeve 16 engages at least in the areas of the latching means 15 in sections in order to facilitate and generate a rotationally fixed connection between the bearing guide element 42 and the bearing element 5. Comparable to the embodiment shown in the FIGS. 2 and 3, the cover module shown in the FIGS. 8 and 9 comprises a lubricant supply line 43, which is arranged at a lubricant intake 32 of the bearing element 5 in a fluid-conveying manner. The lubricant intake 32 is connected to the lubricant channel 30 in a fluid-conveying manner, which extends from the outer surface 5.2 through the material of the bearing element 5 to the inner surface 5.1 and flows in a lubricant outlet opening 31.

In FIG. 10, a perspective view of another embodiment of a sliding cam module 1 according to the invention. This only differs from the embodiment of a sliding cam module 1 according to the invention shown in FIG. 1 due to the fact that the bearing element 5 comprises a smaller bearing diameter, which means a smaller height extending into the radial direction. Consequently, the bearing element 5 is designed with small dimensions in such a way that it stands back—viewed in the radial direction—under the cam heights of the cam 4, 4.1 of the cam segment 3 and 3.1 designed as a full-stroke cam. Favourably, the bearing diameter, in particular, the outer diameter of the bearing element corresponds to the diameter, in particular, the outer diameter of cam 4 or 4.1 or 11.3 of the respective cam segment 3 or 3.1 designed as a full-stroke cam. Provided that the sliding module should be used in a closed bearing structure, favourably, the other cam segment 3.1 is firstly mounted in the cover.

FIGS. 11 and 12 show the embodiment of the sliding cam module 1 according to the invention shown in FIG. 10 is arranged in a cylinder-head cover 41 to form an embodiment of a cover module 40 according to the invention. Essentially, the embodiment of the cover module 40 according to the invention shown in FIGS. 11 and 12 corresponds to the embodiment shown in FIGS. 2 and 3, wherein the recess 13 is only designed to be longer and larger due to the decreased bearing diameter of the bearing element 5—viewed in the radial direction. In order to generate an operational connection between the locking device 10 and the bearing element 5, consequently a recess 13 with very long dimensions in the bearing guide elements 42 is required, which primarily extends from an outer side of the bearing guide elements 42 of the cylinder-head cover 41 radially inward in the direction of the bearing element 5. Accordingly, a correspondingly extended spring element 11, which is arranged in the recess 13, is also required.

REFERENCE LIST

1 sliding cam module
1.1 Through bore
1.2 toothing/longitudinal toothing
2 sliding cam
2.1 mounting section
2.2 outer surface
2.3 positioning section
3 (first) cam segment
3.1 (second/joined) cam segment
4 cam
4.1 cam
5 bearing element
5.1 inner surface
5.2 outer surface
6 recipient area
7 blind hole
8 latching element
9 longitudinal axis
10 locking device
11 spring element
12 engagement element
13 recess
14 closure element
15 latching means
16 sleeve
20 shifting gate
24 camshaft
25 shaft
26 toothing/longitudinal toothing
30 lubricant channel
31 lubricant outlet opening
32 lubricant intake
33 lubricant groove
40 cover module
41 cylinder-head cover
42 bearing guide element
43 lubricant supply line
44 contact surface

The invention claimed is:

1. A sliding cam module for a camshaft, the sliding cam module comprising:

at least one sliding cam with at least one cam segment having at least two cams with respective cam profiles that are different from to one another;

a closed bearing element which is arranged on the at least one sliding cam in a rotatable and axially non-displaceable manner, wherein the closed bearing element includes a recipient area configured to hold at least one section of a locking device for locking the at least one sliding cam in an axial position;

the closed bearing element includes a lubricant channel at least partially extending in a radial direction, the lubricant channel communicates with a lubricant outlet opening on an inner surface of the closed bearing element; and a lubricant intake on an outer surface of the closed bearing element and that communicates with the lubricant channel, the lubricant intake is an elongated hole having a longitudinal axis that extends in an axial direction along the outer surface of the closed bearing element.

2. The sliding cam module according to claim 1, wherein the locking device comprises a spring element and an engagement element interacting with the spring element.

3. The sliding cam module according to claim 2, wherein the recipient area comprises a blind hole extending inwardly in the radial direction to receive the spring element of the locking device.

4. The sliding cam module according to claim 2, further comprising a latching element configured to hold the engagement element of the locking device.

5. The sliding cam module according to claim 1, further comprising a shifting gate with a guide path configured to hold a pin element to displace the sliding cam module in the axial direction along a shaft of a camshaft.

6. The sliding cam module according to claim 1, wherein the closed bearing element comprises a lubricant groove to distribute lubricant, the lubricant groove extends at least partially along the outer surface of the closed bearing element in a circumferential direction.

7. A camshaft comprising:

at least one sliding cam module having:

at least one sliding cam with at least one cam segment having at least two cams with respective cam profiles that are different from one another;

a closed bearing element which is arranged on the at least one sliding cam in a rotatable and axially non-displaceable manner, wherein the closed bearing element includes a recipient area configured to hold at least one section of a locking device for locking the at least one sliding cam in an axial position;

the closed bearing element includes a lubricant channel at least partially extending in a radial direction, the lubricant channel communicates with a lubricant outlet opening on an inner surface of the closed bearing element;

a lubricant intake on an outer surface of the closed bearing element and that communicates with the lubricant channel, the lubricant intake is an elongated hole having a longitudinal axis that extends in an axial direction along the outer surface of the closed bearing element; and a shaft on which the at least one sliding cam module is arranged in a rotationally fixed manner along a longitudinal axis of the shaft.

8. The camshaft according to claim 7, further comprising a toothing on an outer surface of the shaft.

9. The camshaft according to claim 7, wherein the at least one sliding cam module further comprises a through bore extending in the axial direction, the shaft extends through the through bore, and wherein the surface of the through bore comprises a toothing.

10. A cover module for arrangement on a cylinder head of an internal combustion engine, the cover module comprising:

a cylinder-head cover;

at least one camshaft held by the cylinder-head cover, the at least one camshaft includes:

at least one sliding cam module having:

at least one sliding cam with at least one cam segment having at least two cams with respective cam profiles that are different from one another;

a closed bearing element which is arranged on the at least one sliding cam in a rotatable and axially non-displaceable manner, wherein the closed bearing element includes a recipient area configured to hold at least one section of a locking device for locking the at least one sliding cam in an axial position;

the closed bearing element includes a lubricant channel at least partially extending in a radial direction, the lubricant channel communicates with a lubricant outlet opening on an inner surface of the closed bearing element a lubricant intake on an outer surface of the closed bearing element and that communicates with the lubricant channel, the lubricant intake is an elongated hole having a longitudinal axis that extends in an axial direction along the outer surface of the closed bearing element; and a shaft on which the at least one sliding cam module is arranged in a rotationally fixed manner along a longitudinal axis of the shaft.

11. The cover module according to claim 10, wherein the cylinder-head cover comprises at least one bearing path configured for mounting the at least one camshaft and at least two bearing guide elements which are spaced apart from each other in the axial direction, wherein the closed bearing element is arranged on at least one of the at least two bearing guide elements in a rotationally fixed manner and the closed bearing element is selectively displaced in the axial direction on the at least one of the at least two bearing guide elements.

12. The cover module according to claim 11, wherein the at least one of the at least two bearing guide element comprises a lubricant supply line.

* * * * *